US006542713B2

(12) United States Patent
Jones et al.

(10) Patent No.: US 6,542,713 B2
(45) Date of Patent: Apr. 1, 2003

(54) IMAGE-FORMING MACHINE WITH A CONDITIONED CLEANING SYSTEM

(75) Inventors: Kurt E. Jones, Webster, NY (US); Kevin D. Lofftus, Fairport, NY (US); George R. Walgrove, III, Rochester, NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/821,303

(22) Filed: Mar. 29, 2001

(65) Prior Publication Data

US 2002/0141798 A1 Oct. 3, 2002

(51) Int. Cl.[7] ..... G03G 15/00
(52) U.S. Cl. ..... 399/343; 399/346

(58) Field of Search ..... 399/352, 343, 399/346, 127, 128, 129, 100, 148

(56) References Cited

U.S. PATENT DOCUMENTS 5,151,744 A * 9/1992 Lundy et al. ..... 399/71
5,463,455 A * 10/1995 Poziniakas et al. ..... 399/350
6,014,530 A * 1/2000 Tsunemi ..... 399/53

* cited by examiner

*Primary Examiner*—Quana M. Grainger

(57) ABSTRACT

This invention provides an image-forming machine with a conditioned cleaning system, which may have a photoconductor, one or more chargers, a toning station, and a cleaning station. Toner is applied to image areas and toner lubrication areas on the photoconductor. The toner essentially provides a lubricating or protective barrier between the cleaning station and the photoconductor.

19 Claims, 7 Drawing Sheets

IMAGE-FORMING MACHINE WITH A CONDITIONED CLEANING SYSTEM

FIELD OF THE INVENTION

This invention generally relates to image-forming machines. More particularly, this invention relates to image-forming machines having cleaning systems to remove toner and the electrostatic charge from a photoconductor.

BACKGROUND OF THE INVENTION

An image-forming machine transfers images onto paper or other medium. The image-forming machine usually includes a photoconductor, one or more chargers, an exposure machine, a toning station, a fuser station, and a cleaning station. The image-forming machine usually has a logic control unit (LCU) or other microprocessor for controlling and operating the various components.

Generally, the photoconductor is selectively charged and optically exposed to form an electrostatic latent image on the surface. Toner is deposited onto the photoconductor surface. The toner is charged, thus adhering to the photoconductor surface in areas corresponding to the electrostatic latent image. The toner image is transferred onto a sheet of paper or other medium. In the fuser station, the sheet is heated causing the toner to fix or adhere to the paper or other medium. The photoconductor is refreshed, cleaned to remove residual toner and charge, and then is ready to make another image. The sheet exits the image-forming equipment.

As a sheet exits an image-forming machine, the portion of the photoconductor used to produce the image passes through the cleaning station. The cleaning station usually has a cleaning brush positioned to engage the photoconductor. The cleaning brush removes toner, electrostatic charges, fibers of paper or other medium, dust, and the like from the photoconductor. The toner on the photoconductor acts as a lubricant to protect the photoconductor from the brush. However, during the image-forming process, some portions of the photoconductor do not receive much or any toner. Some frames may be skipped because of the paper selection or other operating factors. When a portion of the photoconductor is cleaned without the lubricant properties of toner, the cleaning brush fibers may engage and damage the photoconductor. The portions of the photoconductor lacking toner may become abraded and worn by the cleaning brush. These abraded and worn areas may act as a catalyst for scum and charger rest defects. In addition, the material removed from the photoconductor may coat the cleaning brush fibers. The contaminated fibers may deposit this residual material onto other portions of the photoconductor including the image forming areas. The deposits on the image forming area also may become regions for scum and charger rest contamination, which yield poor image quality when an image is produced in that portion of the photoconductor.

SUMMARY

This invention provides an image-forming machine with a conditioned cleaning system. The image-forming machine applies toner onto one or more image areas and onto one or more toner lubrication areas on a photoconductor. In addition to assisting in the image-forming process, the toner essentially provides a lubricating or protective barrier on the photoconductor.

An image-forming machine with a conditioned cleaning system may have a photoconductor, one or more chargers, a toning station, and a cleaning station. The one or more chargers are positioned near the photoconductor and electrostatically charge one or more image areas and one or more toner lubrication areas on the photoconductor. The toning station also is positioned near the photoconductor and applies toner onto the image areas and the toner lubrication areas. The cleaning station is positioned near the photoconductor and removes toner from the image areas and the toner lubrication areas.

In a method of cleaning an image-forming machine, one or more image areas and one or more toner lubrication areas are electrostatically charged on a photoconductor. Toner is applied to the image areas and the toner lubrication areas. Toner is removed from the image areas and the toner lubrication areas.

Other systems, methods, features, and advantages of the invention will be or will become apparent to one skilled in the art upon examination of the following figures and detailed description. All such additional systems, methods, features, and advantages are intended to be included within this description, within the scope of the invention, and protected by the accompanying claims.

BRIEF DESCRIPTION OF THE FIGURES

The invention may be better understood with reference to the following figures and detailed description. The components in the figures are not necessarily to scale, emphasis being placed upon illustrating the principles of the invention. Moreover, like reference numerals in the figures designate corresponding parts throughout the different views.

DETAILED DESCRIPTION OF THE PREFERRED EMBODIMENTS

Figure 1:
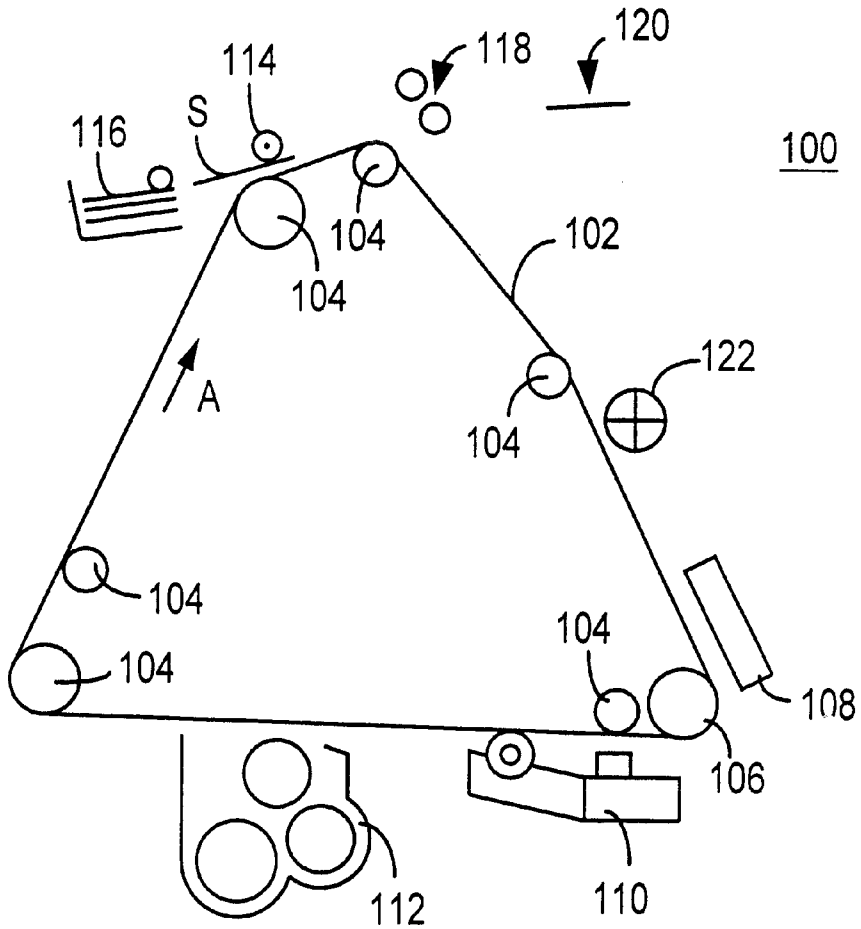
FIG. 1 represents a schematic diagram of an image-forming machine with a conditioned cleaning system according to one embodiment.

FIG. 1 represents a schematic diagram of an image-forming machine 100 with a conditioned cleaning system according to one embodiment. The image-forming machine 100 may be an electrophotographic image-forming machine, a copy machine, a facsimile machine, and the like. The image-forming machine 100 may include a photoconductor 102, support rollers 104, a motor driven roller 106, a primary charger 108, an exposure machine 110, a toning station 112, a transfer charger 114, a fuser station 118, a cleaning station 122, related equipment, accessories, and the like. The related equipment and accessories may be a feeder 116, a discharge tray 120, a logic and control unit (not shown), a user interface (not shown), an inverter (not shown), a housing (not shown), and the like. The feeder 116 provides sheets of paper or medium. The image-forming machine 100 may have other equipment such as an inserter (not shown) and a finisher (not shown). While particular configurations and arrangements are shown, other configurations and arrangements may be used including those with additional and fewer components.

In one aspect, the photoconductor 102 is operatively mounted on the support rollers 104 and the motor driven roller 106, which moves the photoconductor 102 in the direction indicated by arrow A. The primary charger 108, the exposure machine 110, the toning station 112, the transfer charger 114, the fuser station 118, and the cleaning station 122 are operatively disposed adjacent to the photoconductor 102. The feeder 116 is operatively disposed to provide a sheet S of paper or other medium to the transfer charger 114. Multiple sheets may be process in this manner or the like. The photoconductor 102 has a belt and roller-mounted configuration and may have a drum or other suitable configuration. The housing supports and protects various components of the image-forming machine 100, which may be integrated with or part of the housing.

Figure 2:
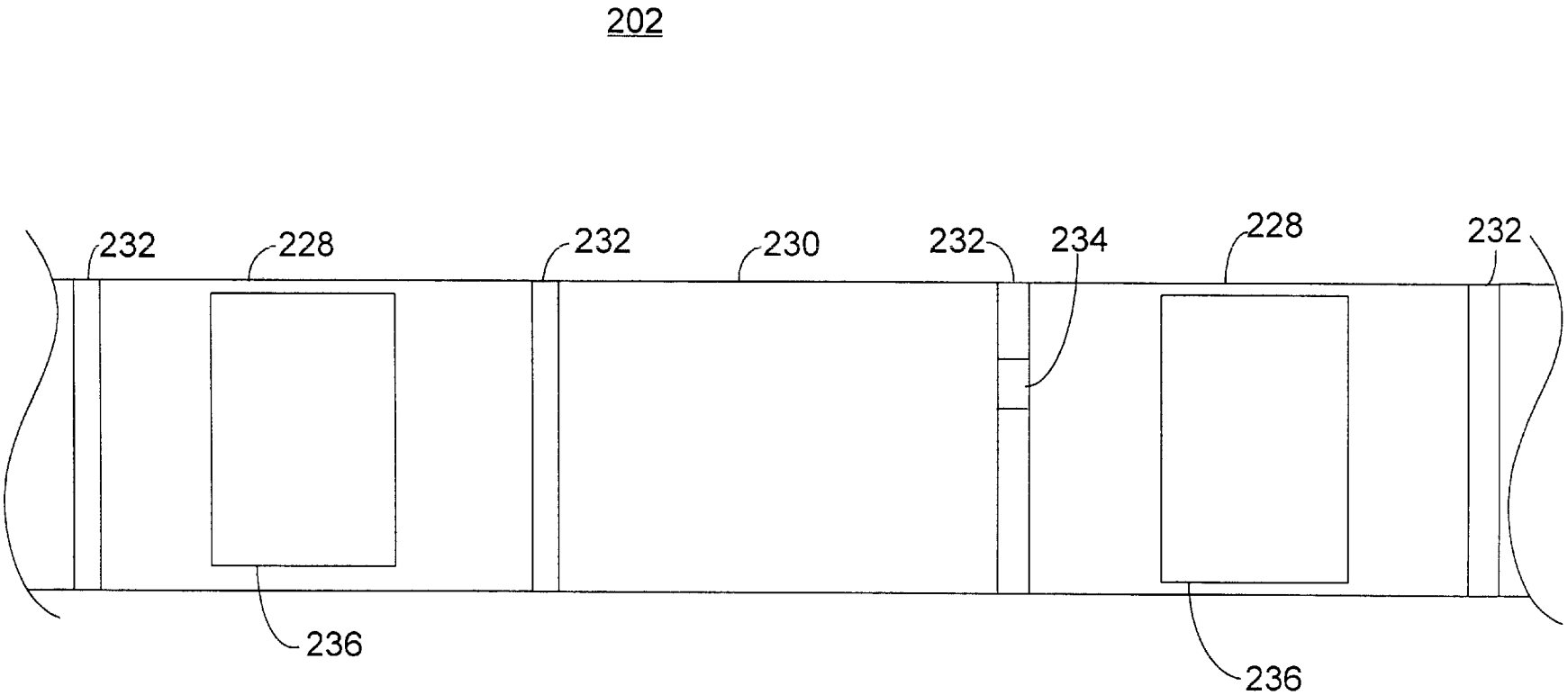
FIG. 2 represents a top view of a photoconductor for the image-forming machine in FIG. 1.

FIG. 2 represents a top view of a photoconductor 202 for the image-forming machine 100 in FIG. 1. The photoconductor 202 is divided into image frames 228 and skip frames 230 separated by interframe areas 232. The image frames 228 and skip frames 230 may be the same or different sizes. The interframe areas 232 also may have the same or different sizes. The photoconductor 202 may have a process patch 234 in one or more of the interframe areas 232. The process patch 234 is used to determine the maximum density of the toner on the photoconductor 202 and may be used for other density measurements. In one aspect, a skip frame 230 always follows an interframe area 232 or other location of the process patch 234. There may be one or more image frames 228, one or more skip frames 230, and one or more interframe areas 232. There may be only one image frame 228 and no skip frame 230 and no interframe area 232. There may be additional skip frames 230, which may have locations on the photoconductor depending on the job ordering sequence.

Each image frame 228 has an image area 236, which may correspond to the paper or medium size used in the image-forming machine. The image area 236 may be for use with a given or maximum paper or medium size. There may be one or more other frames having one or more other image areas for other paper or medium sizes. In one aspect, the image area 236 is for paper or medium 14 inches in length. In another aspect, the image area 236 is for paper or medium 11 inches in length.

To produce images, the primary charger 108 electrostatically charges the image frames 228 on the photoconductor 202. The primary charger 108 does not charge the skip frames 230. The exposure machine 110 optically exposes and forms electrostatic images onto the image areas 236. The toning station 112 applies toner onto the image areas 236. The toner has a charge to adhere to the electrostatic images. The transfer charger 114 transfers the toner from the image areas 236 onto sheets of paper or other medium from the feeder 116. The fuser station 118 receives the sheets from the transfer charger 114 and fuses the toner onto the sheets. The sheets exit the image-forming equipment. The electrophotographic process may be performed for a single or multiple images. As mentioned, there may be additional skip frames depending on the job ordering sequence. There may be more skip frames if additional image areas with different sizes are used.

As a sheet exits the image-forming machine 100, the photoconductor 202 passes through or under the cleaning station 122. The cleaning station 122 has a cleaning brush (not shown) or another debris removal device. In one aspect, the cleaning brush is a fur-type cleaning brush. The cleaning brush is disposed to operatively engage the photoconductor 102 to remove debris, which may include toner, residual or other electrostatic charges, fibers and other portions of paper or other medium, dust, and the like.

During operation of the image-forming machine, toner may be applied onto one or more image areas 236, one or more process patches 234, and one or more toner lubrication areas on the photoconductor 202. Toner lubrication areas may be portions of the photoconductor where little or no toner is applied during the image-forming process. Toner lubrication areas may be portions of the photoconductor where toner is applied by desire or design for lubrication during the image-forming process. The photoconductor is electrostatically charged in the toner lubrication areas for toner to be applied during the electrophotographic process. As the cleaning brush engages the toner in the toner lubrication areas, the toner acts essentially as a lubricating material or protective barrier preventing or reducing contact between the cleaning brush and the photoconductor 202. The toner also may reduce friction between the cleaning brush and the photoconductor.

The toner lubrication areas may be any size and essentially anywhere on the photoconductor 202 except for the image area 236. Toner may be applied to one or more toner lubrication areas during every cycle of the photoconductor or at one or more intervals of the photoconductor operation. The size and location of the toner lubrication areas may be selected to provide toner on portions of the photoconductor where toner would not be placed during the image-forming process. The toner lubrication areas may be in one or more of a portion or the entire area of an interframe area, a skip frame, an image frame, other locations, and a combination of these locations. The toner lubrication areas may be in the portion of a skip frame or an image frame adjacent to an interframe area. The toner lubrication areas also may be in a portion of an image frame outside the image area. The location, size, and other features of the toner lubrication areas may change from one production sequence to another. A toner lubrication area may comprise a single area or multiple areas with more toner. A toner lubrication area also may comprise a larger or smaller are with varying amounts of toner. The process patch also may serve as a toner lubrication area. In which case, a larger area and more toner may be used than what is used for density measurement. In one aspect, the amount of toner applied to the toner lubrication areas is in the range of about 0.07 milligrams/$cm^2$ through about 0.7 milligrams/$cm^2$.

To apply toner onto a toner lubrication area in this embodiment, the primary charger 108 electrostatically charges a toner lubrication area on the photoconductor 202. The toning station 112 applies toner onto the toner lubrication area. The transfer charger 114 may apply a reverse electrical bias to the toner lubrication area for the toner to remain on the photoconductor until the cleaning brush removes it. The exposure machine 110, the fuser station 118, and other components of the image-forming machine 100 may be inactive during this time period. The toner may be applied using control logic in the logic control unit (LCU) or other microprocessor in the image-forming machine 100. The toner may be applied in intervals or in every interframe, skip frame, image frame, or combination of frames. The toner may be applied during set or particular intervals of a production sequence. The intervals may coincide with the process patch.

FIGS. 3–7 show locations of toner lubrication areas on photoconductors according to various embodiments. Like reference numerals in the figures designate corresponding parts throughout the different views.

Figure 3:
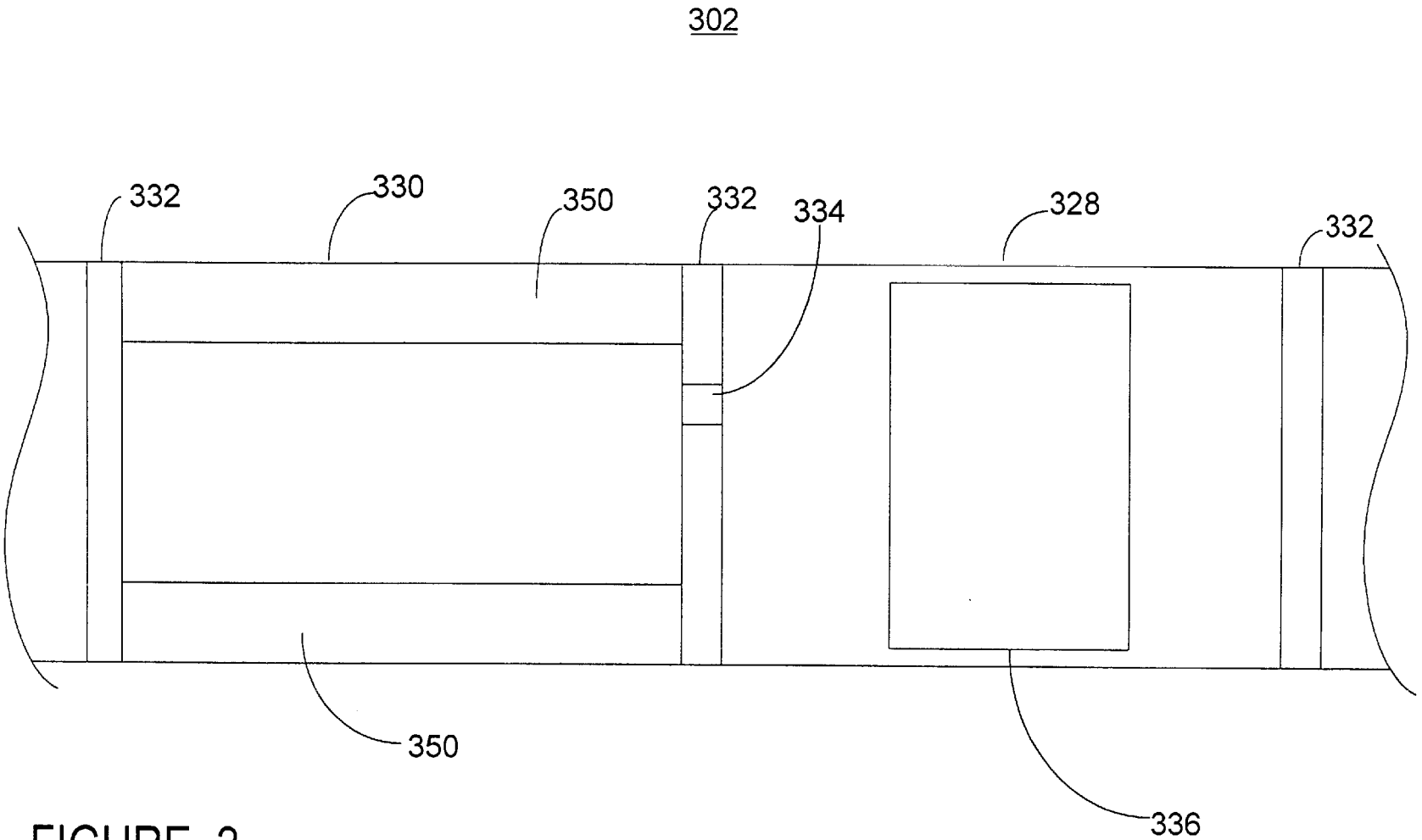
FIG. 3 shows locations of toner lubrication areas in a skip frame following an image frame on a photoconductor according to one embodiment.

FIG. 3 shows locations of toner lubrication areas 350 in a skip frame 330 following an image frame 328 on a photoconductor 302. The toner lubrication areas 350 may be in other locations and have other configurations on the skip frame 330. An interframe area 332 separates the skip frame 330 and image frame 328. The image frame 328 has an image area 336. The interframe area 332 may have a process patch 334. In one aspect, toner is applied to the skip frame 330 that follows the process patch 334.

Figure 4:
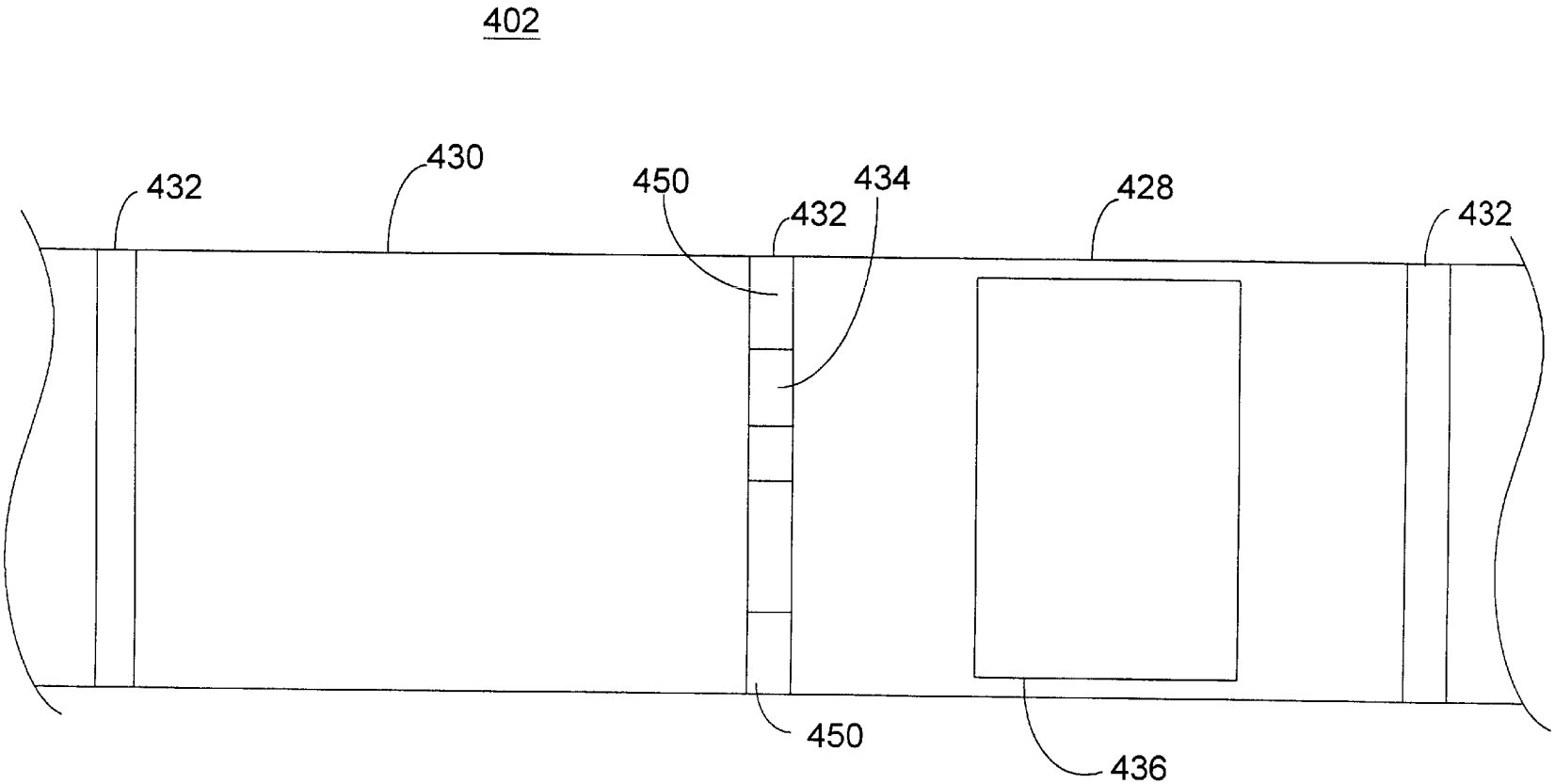
FIG. 4 shows locations of toner lubrication areas in an interframe area between a skip frame and an image frame on a photoconductor according to one embodiment.

FIG. 4 shows locations of toner lubrication areas 450 in an interframe area 432 between a skip frame 430 and an image frame 428 on a photoconductor 402. The image frame 428 has an image area 436. The toner lubrication areas 450 may be in other locations and have other configurations on the interframe area 432. The interframe area 432 may have a process patch 434. In one aspect, the interframe area 432 that has the process patch 434 is imaged with toner.

Figure 5:
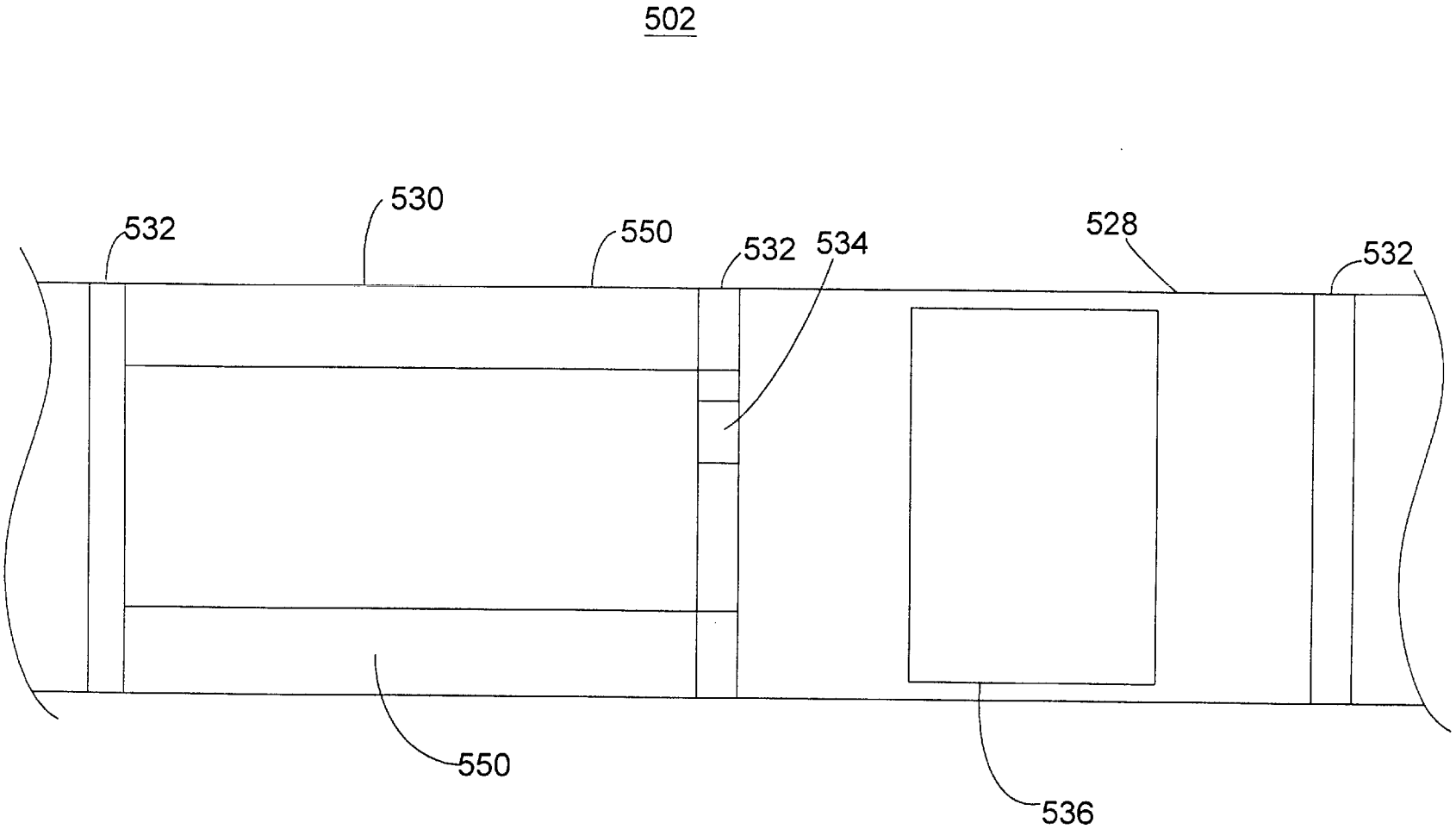
FIG. 5 shows locations of toner lubrication areas in a skip frame and an interframe area following an image frame on a photoconductor according to one embodiment.

FIG. 5 shows locations of toner lubrication areas 550 in a skip frame 530 and an interframe area 532 following an image frame 528 on a photoconductor 502. The toner lubrication areas 550 may be in other locations and have other configurations on the skip frame 530 and interframe area 532. The interframe area 532 may have a process patch 534. The image frame 528 has an image area 536. In one aspect, the skip frame 530 that follows the process patch 534 and the interframe area 532 that has the process patch 534 are imaged with toner.

Figure 6:
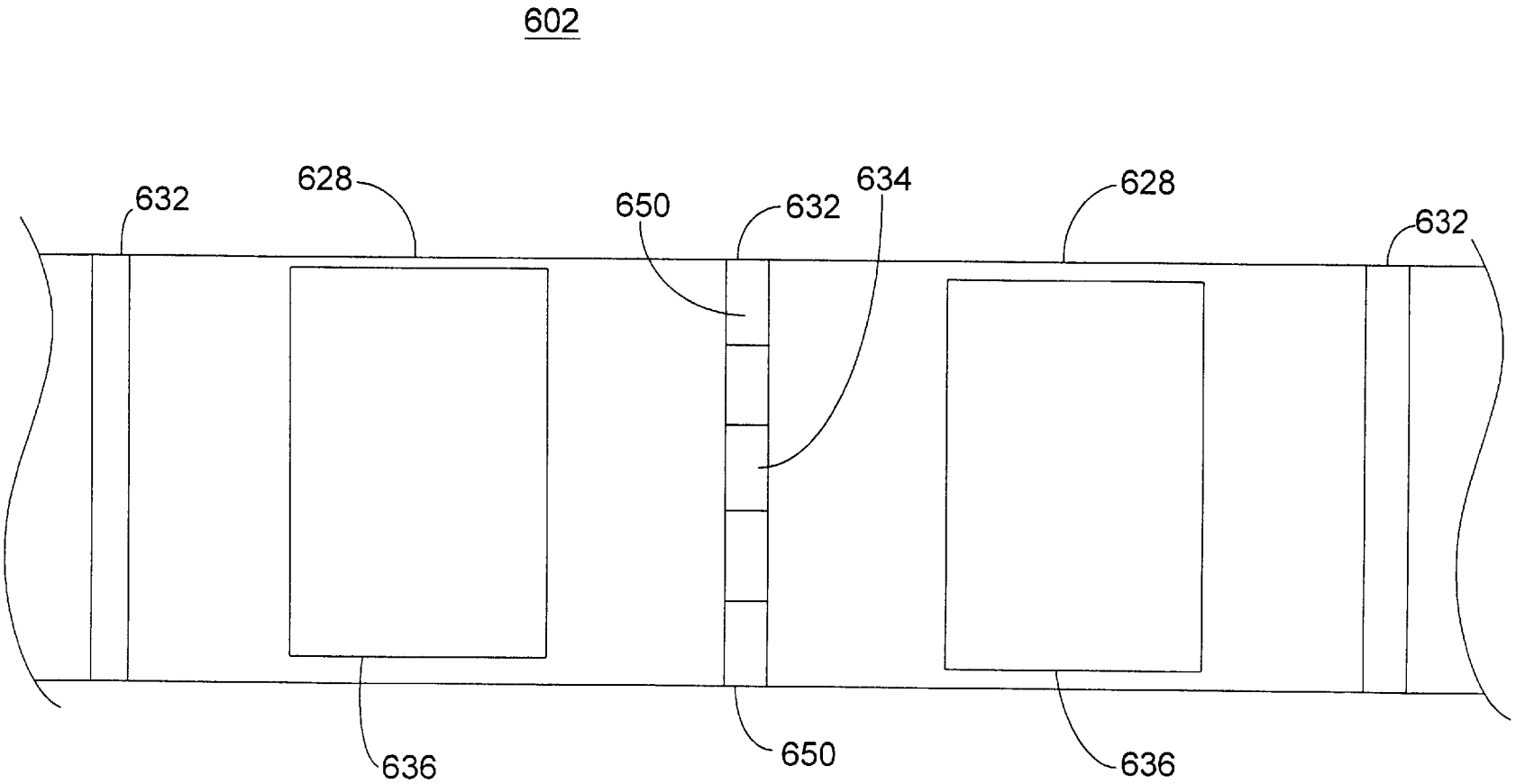
FIG. 6 shows locations of toner lubrication areas in an interframe area with a process patch between two image frames on a photoconductor according to one embodiment.
Figure 7:
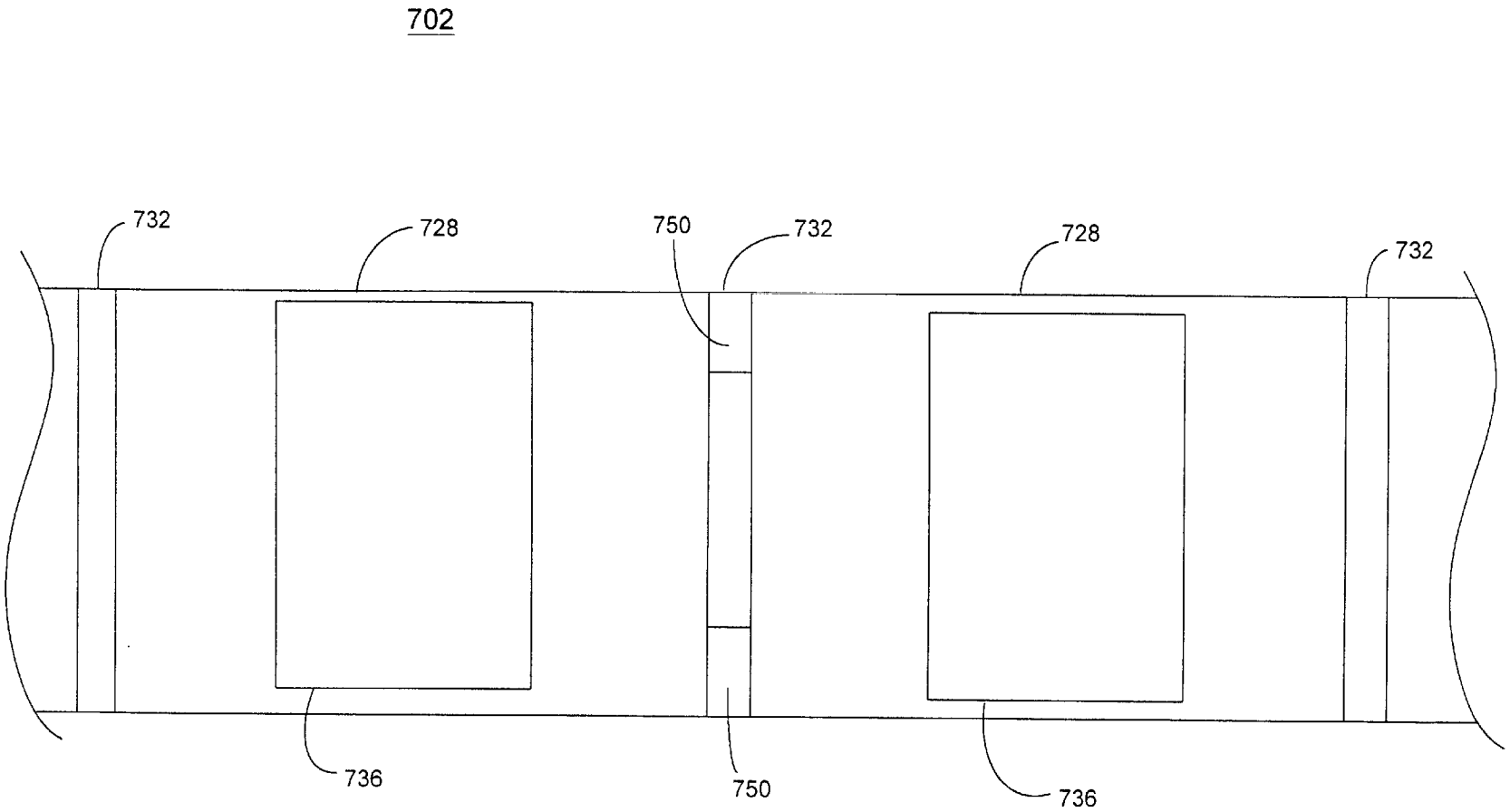
FIG. 7 shows locations of toner lubrication areas in an interframe area without a process patch between two image frames on a photoconductor according to one embodiment.

FIGS. 6–7 show locations of toner lubrication areas 650 and 750 in an interframe area 632 and 732 between two image frames 628 and 728 on photoconductors 602 and 702, respectively. The image frames 628 and 728 have image areas 636 and 736, respectively. The toner lubrication areas 650 and 750 may be in other locations and have other configurations on the interframe area 632 and 732 and may be on the image frames 636 and 736. In FIG. 6, the interframe area 632 has a process patch 634. In one aspect, the interframe area 632 that has the process patch 634 is imaged with toner. In FIG. 7, the interframe area 732 does not have a process patch.

Various embodiments of the invention have been described and illustrated. However, the description and illustrations are by way of example only. Other embodiments and implementations are possible within the scope of this invention and will be apparent to those of ordinary skill in the art. Therefore, the invention is not limited to the specific details, representative embodiments, and illustrated examples in this description. Accordingly, the invention is not to be restricted except in light as necessitated by the accompanying claims and their equivalents.

What is claimed is:

1. An image-forming machine with a conditioned cleaning system, comprising:

a photoconductor;

at least one charger disposed near the photoconductor, the at least one charger to electrostatically charge at least one image area and at least one toner lubrication area on the photoconductor;

a toning station disposed near the photoconductor, the toning station to apply toner onto the at least one image area and the at least one toner lubrication area; and a cleaning brush disposed near the photoconductor, wherein the cleaning brush cleans toner from the at least one image area and the at least one toner lubrication area, thereby being lubricated.

2. The image-forming machine according to claim 1, where the at least one toner lubrication area is in at least one of a skip frame and an interframe area.

3. The image-forming machine according to claim 2, where the interframe area comprises a process patch.

4. The image-forming machine according to claim 1, where the at least one toner lubrication area is in an interframe area between two image frames.

5. The image-forming machine according to claim 4, where the interframe area has a process patch.

6. The image-forming machine according to claim 1, where the at least one toner lubrication area comprises multiple toner lubrication areas disposed on the photoconductor.

7. The image-forming machine according to claim 1, where the toning station applies toner onto the at least one toner lubrication area in the range of about 0.07 milligrams/$cm^2$ through about 0.7 milligrams/$cm^2$.

8. The image-forming machine according to claim 1, where the cleaning station comprises a debris removal device.

9. The image-forming machine according to claim 8, where the debris removal device comprises a fur-type cleaning brush.

10. An image-forming machine with a conditioned cleaning system, comprising:

a photoconductor;

at least one charger disposed near the photoconductor, the at least one charger to electrostatically charge at least one image area and at least one toner lubrication area on the photoconductor;

a toning station disposed near the photoconductor, the toning station to apply toner onto the at least one image area and the at least one toner lubrication area; and a cleaning station disposed near the photoconductor, the cleaning station to remove toner from the at least one image area and the at least one toner lubrication area;

where the at least one toner lubrication area is in at least one of a skip frame and an interframe area; and, where the interframe area is between the skip frame and an image frame.

11. An image-forming machine with a conditioned cleaning system, comprising:

a photoconductor;

at least one charger disposed near the photoconductor, the at least one charger to electrostatically charge at least one image area and at least one toner lubrication area on the photoconductor;

a toning station disposed near the photoconductor, the toning station to apply toner onto the at least one image area and the at least one toner lubrication area; and a cleaning station disposed near the photoconductor, the cleaning station to remove toner from the at least one image area and the at least one toner lubrication area;

where the at least one toner lubrication area is in a skip frame adjacent to an interframe area having a process patch.

12. An image-forming machine with a conditioned cleaning system, comprising:

a photoconductor;

at least one charger disposed near the photoconductor, the at least one charger to electrostatically charge at least one image area and at least one toner lubrication area on the photoconductor;

a toning station disposed near the photoconductor, the toning station to apply toner onto the at least one image area and the at least one toner lubrication area; and a cleaning station disposed near the photoconductor, the cleaning station to remove toner from the at least one image area and the at least one toner lubrication area;

where the at least one charger comprises a primary charger and a transfer charger, where the primary charger electrostatically charges the at least one toner lubrication area, and where the transfer charger applies a reverse electrical bias to the at least one toner lubrication area.

13. A method of cleaning an image-forming machine, comprising:

(a) electrostatically charging at least one image area and at least one toner lubrication area on a photoconductor;

(b) applying toner to the at least one image area and the at least one toner lubrication area; and (c) cleaning toner from the at least one image area and said toner lubrication area with a cleaning brush, wherein toner applied to the at least one toner lubrication area prevents wear of the photoconductor by said cleaning brush.

14. The method according to claim 13, where the at least one toner lubrication area is in at least one of a skip frame and an interframe area.

15. The method according to claim 13, where the interframe area comprises a process patch.

16. The method according to claim 13, where the at least one toner lubrication area is in an interframe area between two image frames.

17. The method according to claim 13, where the interframe area has a process patch.

18. The method according to claim 13, where (b) further comprises applying toner to the at least one toner lubrication area in the range of about 0.07 milligrams/$cm^2$ through about 0.7 milligrams/$cm^2$.

19. A method of cleaning an image-forming machine, comprising:

(a) electrostatically charging at least one image area and at least one toner lubrication area on a photoconductor;

(b) applying toner to the at least one image area and the at least one toner lubrication area;

(c) removing toner from the at least one image area and the at least one toner lubrication area; and (d) applying a reverse electrical bias to the at least one toner lubrication area.

* * * * *